US006863007B2

(12) United States Patent
Flückiger

(10) Patent No.: US 6,863,007 B2
(45) Date of Patent: Mar. 8, 2005

(54) METHOD FOR DETERMINING A LOWER THREAD SUPPLY, AND A SEWING MACHINE HAVING A LOWER THREAD SUPPLY MONITORING DEVICE

(75) Inventor: Hans Flückiger, Oetwil am See (CH)

(73) Assignee: Fritz Gegauf Aktiengesellschaft Bernina-Nahmaschinenfabrik, Steckborn (CH)

( * ) Notice: Subject to any disclaimer, the term of this patent is extended or adjusted under 35 U.S.C. 154(b) by 28 days.

(21) Appl. No.: 10/653,330

(22) Filed: Sep. 2, 2003

(65) Prior Publication Data

US 2004/0040482 A1 Mar. 4, 2004

(30) Foreign Application Priority Data

Sep. 2, 2002 (CH) ..... 01491/02

(51) Int. Cl.[7] ..... D05B 59/02

(52) U.S. Cl. ..... 112/475.01; 112/278

(58) Field of Search ..... 112/278, 273, 112/475.01, 475.02; 250/559.4; 200/61.18

(56) References Cited

U.S. PATENT DOCUMENTS 5,103,750 A * 4/1992 Sato et al. ..... 112/278
5,353,726 A * 10/1994 Bruder et al. ..... 112/475.01
5,651,324 A * 7/1997 Arnold ..... 112/278

* cited by examiner

*Primary Examiner*—Peter Nerbun
(74) *Attorney, Agent, or Firm*—Volpe and Koenig, P.C.

(57) ABSTRACT

From a light source (51), light beams (57) are directed tangentially through the hook body (17), the hook base (27), and the bobbin case (28), onto a light receiver (53). Using the time (t) or the position of angular rotation of the hook body (17) at the impingement of the first light beam (57), the diameter of the bobbin packing on the lower thread bobbin (29) can be calculated.

5 Claims, 5 Drawing Sheets

METHOD FOR DETERMINING A LOWER THREAD SUPPLY, AND A SEWING MACHINE HAVING A LOWER THREAD SUPPLY MONITORING DEVICE

BACKGROUND

The subject matter of the present invention is a method for determining the lower thread supply, and a sewing machine having a lower thread supply monitoring device which includes a light transmitter and a light receiver, in which a light beam bundle from the light transmitter is directed through slits in the hook base and through peripheral openings situated in the hook body, tangential to the bobbin core and to the thread wound thereon, through the packing space between the flanges, and at least one of the light beams is received by the light receiver, and the received signal is forwarded to the machine control unit for the calculation of the bobbin packing diameter.

In sewing and embroidery using a sewing machine, it is known that two threads, the upper thread and the lower thread, are looped with one another. The upper thread, called the needle thread, is supplied from a spool situated on or next to the sewing machine; the size of this spool can essentially be freely chosen. The second thread, called the lower thread, is wound on a bobbin that is placed in the interior of the hook body, which is rotationally mounted and can be driven rotationally, of the sewing machine, and is held there so as to be freely rotatable. As a result, the maximum size of the lower thread bobbin is determined by the size of the hook. The wound-on lower thread quantity, or the lower thread supply, is always smaller by an order of magnitude in relation to the upper thread supply on the spool situated outside the machine housing, and therefore must be refilled or exchanged more often. In addition, during sewing operation the lower thread spool is not visible from the outside, because it is situated inside the hook housing, which is located in the lower arm. For this reason, the monitoring of the momentary lower thread supply and of the pulling off of the lower thread during the sewing process is difficult. Moreover, the situation is made more difficult by the fact that during the sewing of smaller articles, the operator will frequently wrap a partly already-filled lower thread bobbin with another thread, because no empty bobbin is present. This other thread is not connected with the one already present on the spool. After this outer thread has been used, a seam can no longer be produced, although for example 50% or 70% of another thread may for example still be wound on the bobbin core.

From the prior art, measurement devices are known with which it is attempted to determine the end or the remaining quantity of the lower thread on the lower thread bobbin held in rotational fashion in the hook, and to halt the sewing machine before the end of the lower thread is drawn out by the upper thread through the article being sewed, and in particular before additional stitches are sewed that are consequently not held onto the underside of the article being sewed by a lower thread.

From GB-A 2 296 721, an apparatus is known for acquiring the quantity of thread remaining on the lower thread bobbin of a sewing machine. Here, a beam of light from a light transmitter is sent in essentially tangential fashion through the annular space between the two bobbin flanges and the bobbin mandrel, to a light receiver. For this purpose, in the hook housing and in the bobbin housing holes are provided that are situated diagonally opposite one another, through which the light beams can be sent. The light beams are directed so as to pass very close to the bobbin mandrel, so that the end of the thread supply can be determined as soon as the light beams can pass through this region. If the bobbin is still filled with thread, the receiver cannot receive a light signal. A second sensor detects the movements of the hook, so that it can be clearly recognized whether the thread supply has been used up or whether the hook is merely standing still. Using such a device, the thread supply can be detected only shortly before the complete emptying of the spool.

U.S. Pat. No. 4,825,789 discloses another device for acquiring the thread end on the lower thread bobbin of a sewing machine. In this device as well, a light beam is directed from a light transmitter tangentially past the bobbin mandrel to a light receiver. As long as there is a supply of thread on the bobbin, the light beam cannot reach the light receiver. Only shortly before the end of the thread is it possible for these sensors to alert the operator of the machine by a signal that indicates the end of the thread in the lower thread bobbin.

Thus, both the known devices can recognize only the thread end, or the time before the end of the thread is reached. Breaks in the thread, or a determination of the momentary existing quantity of thread and thus the time at which the end of the thread will be reached, cannot be recognized using the known devices.

SUMMARY

The object of the present invention is to provide a method for determining the lower thread supply, and to provide a sewing machine having a lower thread monitoring system with which the momentary quantity of thread on the lower thread bobbin can be determined at all times. A further object is the calculation of the time at which the end of the lower thread on the lower thread bobbin will be reached, based on the thread quantity consumed per time unit.

These objects are achieved according to the present invention by a method for determining the lower thread supply in a sewing machine in which the momentary angle of rotation (alpha) of the shuttle element and/or the time (t) is acquired when a light beam is registered by the light receiver, and by a sewing machine having a lower thread supply monitoring system in which a light receiver comprising a CCD element, a photocell, or a phototransistor is used, and the light receiver registers the location of impingement of the first and/or last light beam on the light receiver, and is connected with the machine control system.

Further advantageous constructions of the present invention are provided in the dependent claims.

Using a light source situated at a distance radially from the hook body, light beams, directed tangentially to the axis of rotation of the bobbin or of the hook, can be sent through the hook body onto a light-sensitive element, and there the time of the impingement of the first light beam can be compared with the momentary angle of rotation of the hook, and in this way the diameter of the momentary thread supply on the bobbin can be precisely determined. Using the same device, namely the light source and a light-sensitive element that extends over a finite length, the location of the impinging of the light beam can also be compared, together with the knowledge of the momentary angle of rotation of the bobbin, and in this way the diameter of the supply of thread can be determined. Furthermore, using the same system, by measuring the time duration during which a light beam impinges on the light-sensitive element it is possible to determine the bobbin diameter, and thus the supply of thread. Of course, the possible measurement parameters can also be used in combination to determine the supply of thread, in order to increase the precision of measurement. The precision cannot be adversely affected by small particles of lint, dust, abrasion, or other influences. In addition, more economic elements (a light-emitting diode and a light-sensitive element) can be used. Together with a continuous measurement of the average bobbin rotational speed, using suitable means, and the chronological curves of the decrease of the diameter and the lower thread consumption per stitch, the end of the thread can be calculated independent of the thickness of the thread.

BRIEF DESCRIPTION OF THE DRAWINGS

The present invention is explained in more detail on the basis of several exemplary embodiments.

DETAILED DESCRIPTION OF THE PREFERRED EMBODIMENTS

Figure 1:
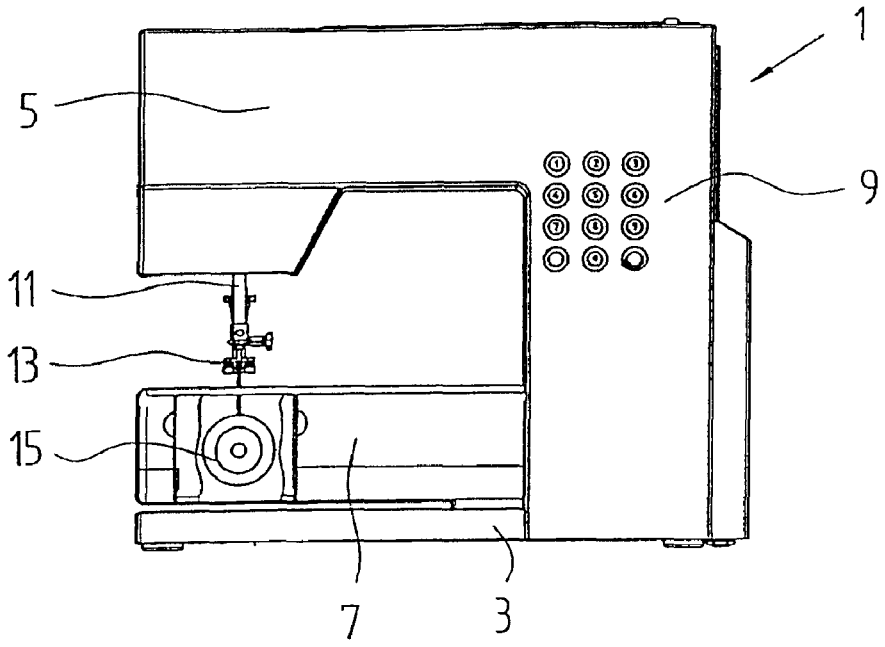
FIG. 1 shows a side view of a schematically shown sewing machine, with a free arm, cut away in the area of the bobbin, of a free-arm sewing machine.

The free-arm sewing machine 1 shown as an exemplary embodiment in FIG. 1 in purely schematic fashion comprises a base 3, an upper arm 5, a lower or free arm 7, and a machine housing 9 connecting the three parts. In the upper arm 5, a needle bar 11 and the needle foot bar 13 are fastened. In the lower arm 7, a hook 15 is indicated schematically by a circle in the cut-away area. The details of hook 15 are shown in enlarged fashion in FIGS. 2 to 4.

The hook 15 described in the exemplary embodiment comprises, besides other elements, a hook body 17 that is seated on a drive shaft 19 that stands in drive connection with the main shaft (not shown) of the sewing machine drive via a pinion 21. It is unimportant whether the hook is a rotating hook fastened in a fixed manner on the drive shaft or an oscillating shuttle that is placed loosely in the hook driver and consequently is not situated fixedly on the drive shaft 19.

Figure 2:
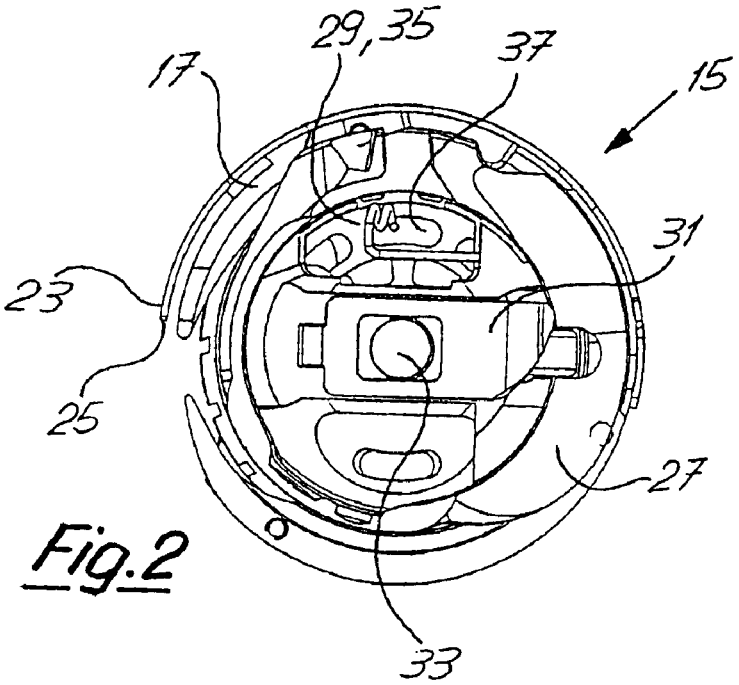
FIG. 2 shows a view of a hook in the axial direction.
Figure 3:
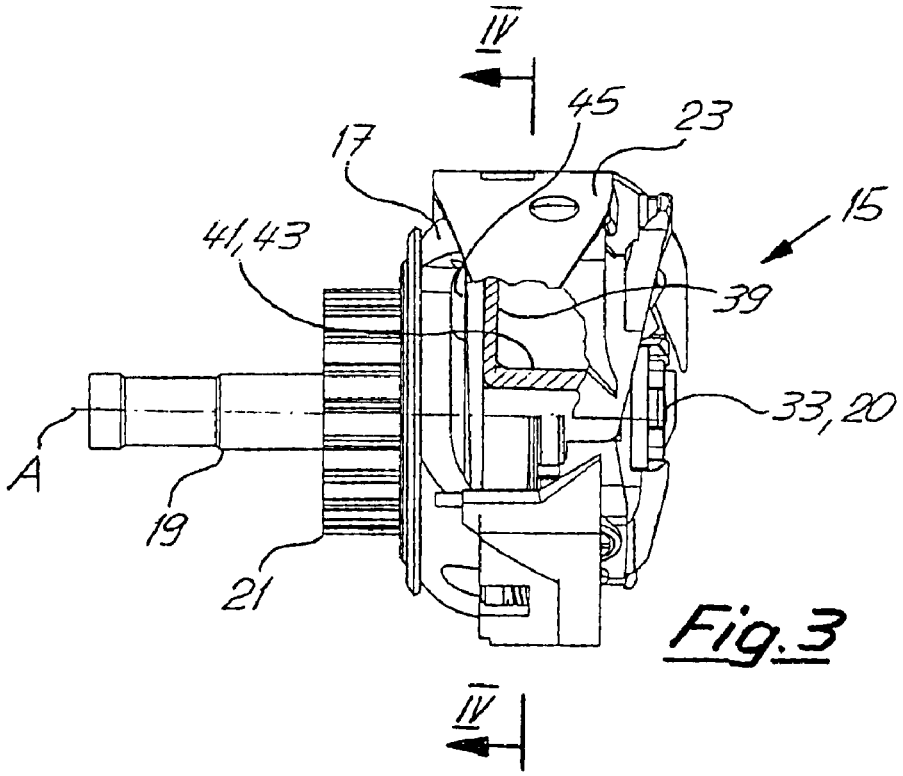
FIG. 3 shows a view of the hook shown in FIG. 2 in a side view (partially cut away)

A thread protection or catch plate 23 having a catch tip 25 is seated peripherally on the hook body 17. Inside the hook body 17, a hook base 27 is mounted in freely rotating fashion on the front end of drive shaft 19 in order to accept a bobbin case 28 for a lower thread bobbin, designated bobbin 29. By means of a lock 31, the bobbin case 28 is held fast on front end 33 of a shaft stub 20 that is fastened in hook base 27 coaxial to drive shaft 19. In FIG. 2, only a small section of front flange 35 of the bobbin 29 is visible. Openings 37 arranged in annular fashion are made in flange 35. Rear flange 39 of bobbin 29 can be seen in FIG. 3. Here, the front flange 35 is covered by the bobbin case 28. Likewise, here crown 41 of bobbin core 43 of bobbin 29 is partly visible. These two latter elements are visible due to openings 45' and 45" in hook body 17 and slits 49', 49" in hook base 27, allowing a tangential view through hook 15.

In order to enable the view through, i.e., the conducting of light beams 57 from a peripherally situated light source 51, the bobbin case 28 is also peripherally enclosed by a jacket only over approximately 180 angular degrees.

Figure 4:
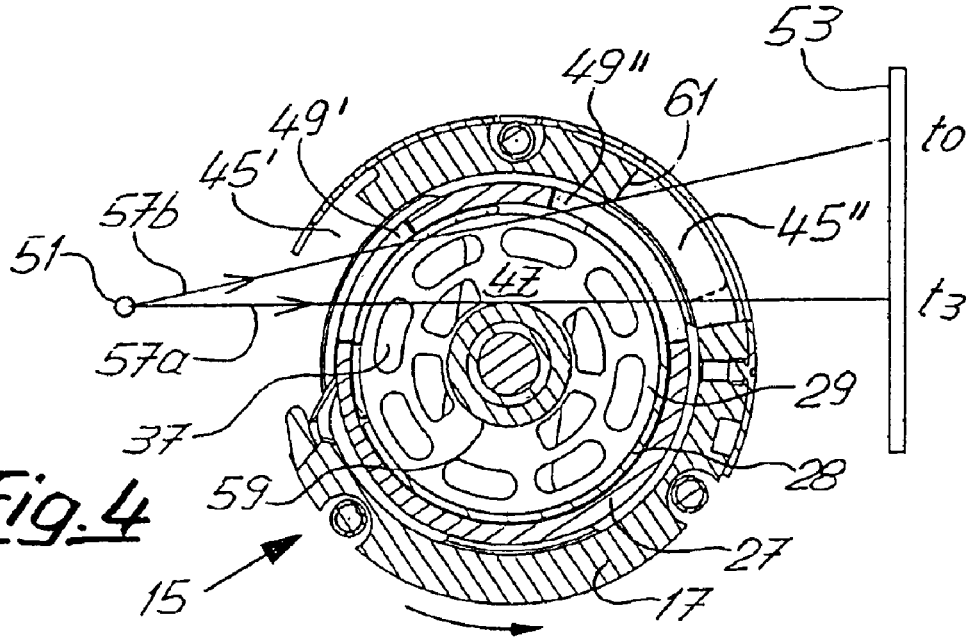
FIG. 4 shows a cross-section along line IV—IV in FIG. 3.

A view through hook 15 is then possible if the two openings 45', 45" on the hook body 17 and slits 49', 49" in the hook base 27, as well as the part left uncovered in the housing of bobbin case 28, coincide with one another. Since during sewing, the hook base 27 is at rest relative to sewing machine housing 9, the view through opening 45' on hook body 17 is possible if openings 45', 45" and slits 49', 49", situated opposite one another, are situated above axis of rotation A of drive shaft 19 (as shown in FIG. 4).

The cross-section of the view through, which is possible once per shuttle rotation, depends—besides depending on the constructively defined geometry of hook 15 and the dimensions of openings 45', 45" and slits 49', 49"—only on the momentary packing diameter D of the thread wound on bobbin 29 in annular packing area 47. Given full packing, the cross-section of the view through is at its smallest (see FIG. 5*a*); when the packing is empty it is at its largest (cf. FIG. 5*c*). The respective lower boundary of the view cross-section in fixed opening 45" is given by crown 41 of the bobbin packing or of the bobbin core 43, and the upper boundary is given by the respective position of edge 61—the front edge in direction of rotation P—of opening 45".

The position of the angular rotation of the hook 15 per rotation at which the passing through of the beams is acquired can be used directly as a measure for calculating the momentary hook diameter D. Here the measurement procedure is explained in more detail At a radial distance from the periphery of the hook 15, there are situated a light source 51 and, on the other side of the hook 15, i.e. essentially diagonally opposite, a light receiver 53 having a receiving region (vertical line in FIG. 5) that extends at least over a length $a_0$–$a_3$, which is able to receive beams 57*a*-57*b* of beam bundle 57 sent out from light source 51. Light beams 57*a*–57*b* penetrate both the two openings 45', 45" in the hook body 17 and also the slits 49', 49" in the hook base 27, when these come briefly into coincidence. A coincidence of the openings 45', 45" and the slits 49', 49" thus takes place once per complete rotation of hook body 17, or once during a cycle in the case of oscillating hooks 15. FIG. 4, which shows a cross-section through the hook 15, clearly shows the geometrical position of the openings 45', 45" and of the slits 49', 49". In addition, the light beams 57*a*, 57*b*, which emanate from the light source 51 and which limit the beam bundle 57 at the top and at the bottom, can be seen, which impinge on the light receiver 53 through the hook 15. The light beam 57*a* represents a tangent between the light source 51 and bobbin core 59. The light beam 57*b* is likewise a tangent to the packing of a full bobbin, whose diameter corresponds approximately to the diameter of the flanges of lower thread bobbin 29. The two light beams 57*a*, 57*b* in FIG. 4 and also in FIG. 5*c* consequently represent the two extreme values of the beam bundle 57. As a light receiver 53, a CCD element, a photodiode or phototransistor, or some other light-sensitive element can be used.

In the exemplary embodiments shown, the light emitted by the light source 51 passes through the hook 15 to the light receiver 53 as a diverging beam bundle 57, as soon as the front edge 61 in the direction of rotation P of opening 45" enables the passage of light beams. The light beam 57*x*, which is determined by the thread packing, is the first that can be acquired by the light receiver 53.

Figure 5A:
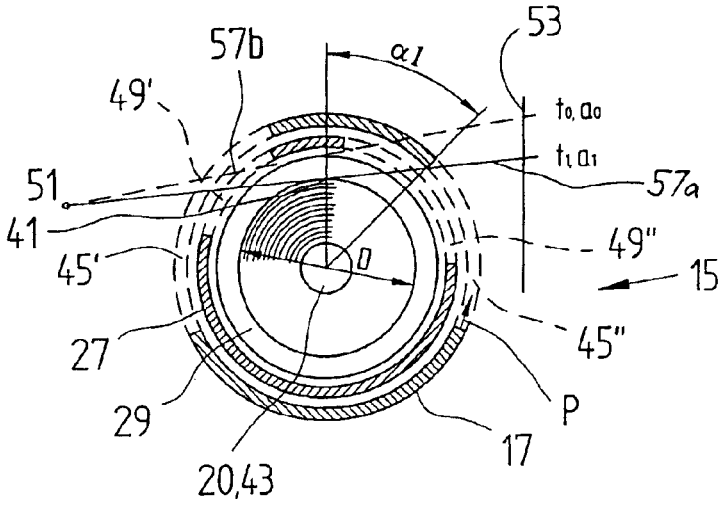
FIG. 5*a* shows a schematic view of a rotating hook having a bobbin arranged therein, having approximately the maximum quantity of thread, in which the front edge of the opening represents the beginning of a measurement.
Figure 5B:
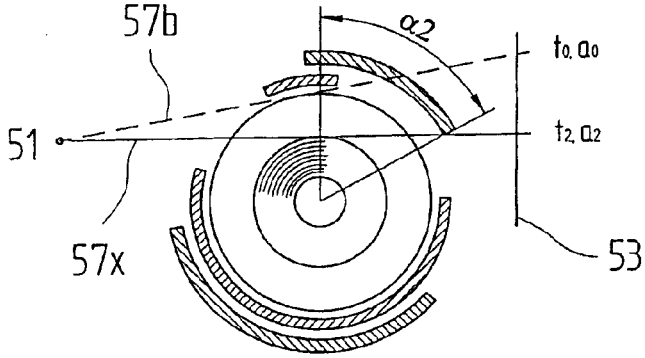
FIG. 5*b* shows a schematic view of a rotating hook having a bobbin situated therein, packed to half its capacity.
Figure 5C:
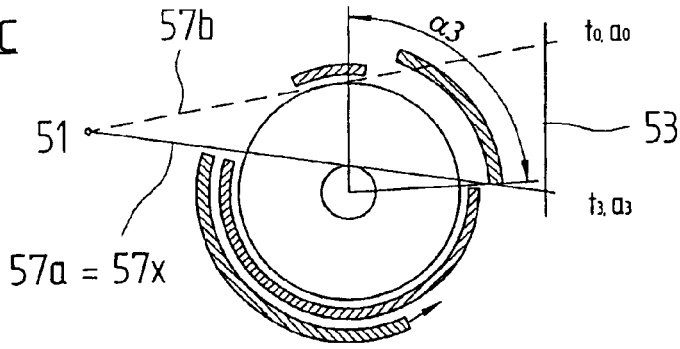
FIG. 5*c* shows a schematic view of a rotating hook having a bobbin situated therein, with the bobbin being empty.

In FIGS. 5*a* to 5*c*, hook body 17 rotates counterclockwise, i.e., in the direction of arrow P. The "first" light beam is designated 57*x*. If the bobbin 29 is empty, the first light beam 57*x* corresponds to the light beam 57*a*, and reaches the light receiver 53 at point $a_3$ (cf. FIGS. 4 and 5*c*). However, if the bobbin 29 is completely filled with thread, the predominant part of packing space 47 does not let light through. As a consequence, the first light beam 57*x* can pass through only further above, and impinges on the light receiver 53 at point $a_1$ (cf. FIG. 5*a*). FIG. 5*b* shows the situation with a half-filled spool 29. Here, the first light beam 57*x* impinges at point $a_2$, which is situated between the two extremes $a_1$ and $a_3$. Alternatively to a diverging light bundle, a light bundle having beams that run in parallel can also be used.

In the following, four possibilities are shown for the device for determining diameter D of the thread packing. The momentary position of the front edge 61 of the opening 45" is assumed as known in Example 2. Its position can be calculated from the rotational position of the main shaft of sewing machine 1.

EXAMPLE 1 (Location)

Figure 6A:
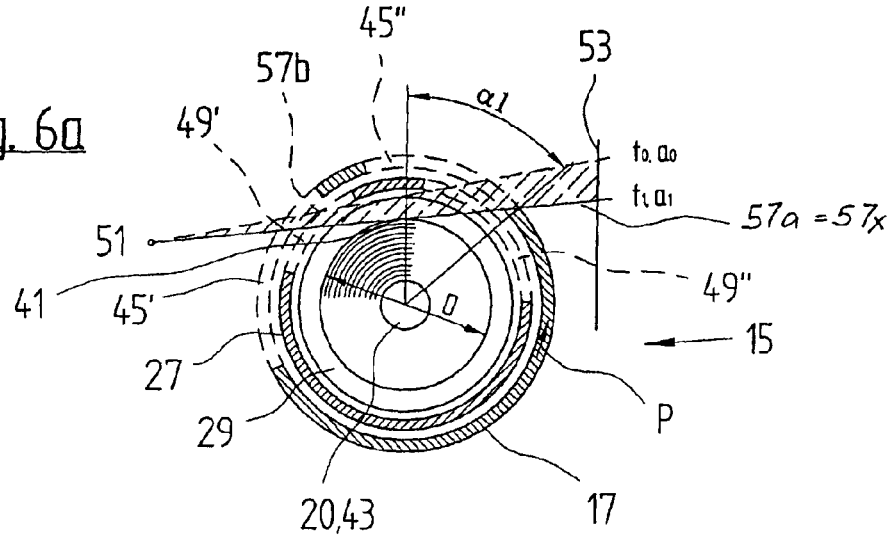
FIG. 6*a* shows a schematic view of a rotating hook having a bobbin situated therein, having approximately the maximum quantity of thread, in which the rear edge of the opening represents the beginning of the measurement.
Figure 6B:
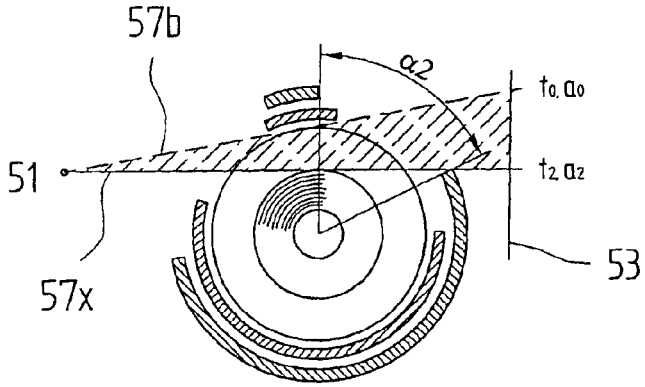
FIG. 6*b* shows a schematic view of a rotating hook having a bobbin situated therein, packed to half its capacity.
Figure 6C:
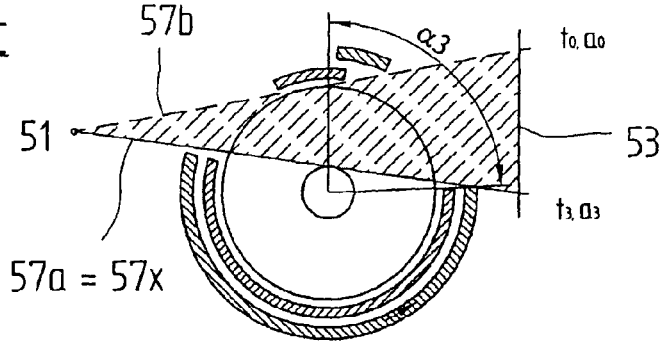
FIG. 6*c* shows a schematic view of a rotating hook having a bobbin situated therein, the spool being empty.

The light receiver 53 recognizes location $a_1$ to $a_3$ of the impingement of the first light beam 57*x* that impinges on light receiver 53, as soon as the front edge 61 of the opening 45" permits the light beam 57*x* to pass through. The recognition of the location ($a_1$ to $a_3$)) of the impingement of the first light beam 57*x* on the light receiver 53 enables the direct calculation of the packing diameter D, because there is a direct geometrical relation (FIGS. 5*a*–5*c*). Alternatively, the location of the last light beam could be acquired before the rear edge 62 on the opening 45" begins to close the light cone (FIGS. 6*a*–6*c*).

EXAMPLE 2 (time)

The time $t_1$ of the impingement of the light beam 57*x* is acquired, and is compared with the position of angular rotation alpha of the front edge 61 on hook body 17. From these two parameters, diameter D of the packing can likewise be calculated (FIGS. 5*a*–5*c*; FIGS. 6*a*–6*c*).

EXAMPLE 3 (duration of exposure)

The times $t_x$ to $t_0$ of the impingement of the first light beam 57*a* up to the disappearing of the last light beam on the receiver 53, i.e., the duration of exposure, are acquired. Together with the known rotational speed n of the hook 15 and the size of opening 45", the diameter D of the bobbin packing can likewise be calculated (width of the light cone in FIGS. 6*a*–6*c*).

EXAMPLE 4 (quantity of light)

Instead of the time duration $t_x$ to $t_0$, as described in Example 3, the quantity of light or light energy (mW) impinging on the receiver 53 can be acquired and used to calculate diameter D. The precision of this measurement is however less than that in Example 3, because errors are unavoidable, due for example to lint and alteration of light source 51 (surface of the light cone in FIGS. 6*a*–6*c*).

The above examples for acquiring data for calculating packing diameter D can also be combined in order to increase precision. Using the four possible types of measurement, it is possible to determine not only the momentary diameter D but also the decrease of diameter D that results per time unit, and thus also the consumption of thread, as well as the time at which the thread on the bobbin 29 is completely used up.

The continuous measurement of diameter D of bobbin packing 47 thus makes it possible to determine the momentary thread consumption independent of the thickness of the thread. As an additional parameter, in this case the average rotational speed n of bobbin 29 is required. Known means are available for the acquisition of the rotational speed n of the bobbin.

Knowledge of the thread consumption can additionally be used to regulate the tension of the upper thread. If the thread consumption per stitch is greater than the known theoretical value that results from the type of stitch and the stitch length, as well as the thickness of the article being sewed, then the upper thread tension is too great, and the lower thread is drawn too deeply into the article being sewed. By loosening the upper thread tension, the drawing of the lower thread into the article being sewed can be brought to the desired value. Analogously, if the lower thread consumption is too small in comparison with the theoretical value, this indicates that the upper thread tension is too low, and consequently must be increased.

In order to determine the rotational speed n of the lower thread bobbin 29, the known means, as described for example in DE-A-4 116 638, which is incorporated herein by reference as if fully set forth, may be used. A reliable measurement of the rotational speed n of the lower thread bobbin 29 can also be obtained using a device as disclosed in Swiss patent application 00893/02, dated May 30, 2002. Using the measurement method or device disclosed there, the rotational speed n of the lower thread bobbin 29 can be acquired reliably at all times, and in particular a rest state of lower thread bobbin 29 can be recognized immediately. This holds even when vibrations of the sewing machine cause lower thread bobbin 29 to vibrate, which can be misinterpreted as a "non-rest state." This makes it possible to determine a break in the thread, or the end of a thread wrapped on an already-existing thread on lower thread bobbin 29, and to halt the sewing machine before the lower thread can leave the stitch plate. A further advantage of the measurement of the rotational speed is that the direction of rotation of the bobbin 29 can be recognized. If the bobbin has been put into place incorrectly, a signal results.

LIST OF REFERENCE CHARACTERS

1 sewing machine
3 base
5 upper arm
7 lower or free arm
9 machine housing
11 needle bar
13 needle foot bar
15 hook
17 hook body
19 drive shaft

21 pinion
23 thread protection plate
25 catch tip
27 hook base
28 bobbin case
29 lower thread bobbin
31 lock
33 front end
35 front flange
37 annularly situated openings
39 rear flange
41 crown
43 bobbin core
45 openings
47 packing space
49 slits in 27
51 light source
53 light receiver
57 light beams
57*a* light beam
57*b* light beam
59 bobbin core
61 front end

What is claimed is:

1. A method for determining the lower thread supply on the lower thread bobbin (29) of a sewing machine (1) having a light transmitter (51) and a light receiver (53), comprising directing a light beam bundle (57) from the light transmitter (51) through slits (49', 49") in a hook base (27) and through peripheral openings (45', 45") situated in a hook body (17), tangential to a bobbin core (43) and to a thread packing, through a packing space (47) between flanges (35, 39); receiving at least one of the light beams (57*x*) by a light receiver (53); forwarding a received signal to a machine control unit for the calculation of a spool packing diameter (D); and acquiring a momentary angle of rotation (alpha) of the hook body (17) and/or a time (t) when one of the light beams (57*x*) is registered by the light receiver (53).

2. The method as recited in claim 1, wherein a location ($a_x$) of a first and/or a last of the light beams (57*x*) on the light receiver (53) is acquired.

3. The method as recited in claim 1, wherein a duration of light reception and/or light quantity impinging on the light receiver (53) during a hook rotation is acquired.

4. A sewing machine having an lower thread supply monitoring system, comprising a hook (15) having a hook body (17), a hook base (27) located in the hook body (17), and a freely rotatable lower thread bobbin (29) located in a bobbin case (28) in the hook base (27), and comprising a light transmitter (51) and a light receiver (53), slits (49', 49") and openings (45', 45") being made in a periphery of the hook body (17) and in a housing of the hook base (27), which admit a tangential passage of light beams (57) from the light source (51) to the light receiver (53) through a packing space (47) on the bobbin (29), the light receiver (53) comprising one of a CCD element, a photocell, or a phototransistor, the light receiver (53) registering a location of impingement of a first and/or a last light beam (57*a*, 57*b*) on the light receiver (53), and being connected with a machine control system.

5. The sewing machine as recited in claim 4, wherein the light receiver (53) comprises means that acquire a received light quantity and/or exposure duration.

* * * * *